United States Patent [19]

Koehn

[11] Patent Number: 5,056,731

[45] Date of Patent: Oct. 15, 1991

[54] FISHTAPE REEL AND HANDLE

[75] Inventor: Terry J. Koehn, Geneva, Ill.

[73] Assignee: Ideal Industries, Inc., Sycamore, Ill.

[21] Appl. No.: 460,377

[22] Filed: Jan. 3, 1990

[51] Int. Cl.[5] ..... E21C 29/16; B65H 75/36

[52] U.S. Cl. ..... 242/96; 254/134.3 FT

[58] Field of Search ..... 242/96, 84.8, 85.1; 254/134.3 FT

[56] References Cited

U.S. PATENT DOCUMENTS

| | | | |
|---|---|---|---|
| 1,956,806 | 5/1934 | Mitzen | 242/77 |
| 2,556,484 | 6/1951 | Raney | 175/376 |
| 2,718,376 | 9/1955 | Raney | 254/134.3 |
| 2,844,334 | 7/1958 | Luth | 242/128 |
| 2,913,222 | 11/1959 | Kuzara | 254/134.3 |
| 2,928,656 | 3/1960 | Lindsey | 254/134.3 FT |
| 3,053,472 | 9/1962 | Stewart | 242/96 |
| 3,145,972 | 8/1964 | Sweeney | 254/134.3 |
| 3,424,435 | 1/1969 | Niemann | 242/84.8 X |
| 3,582,044 | 6/1971 | Gardner | 254/134.3 FT |
| 4,390,142 | 6/1983 | Cheng | 242/96 |

*Primary Examiner*—John M. Jillions

*Attorney, Agent, or Firm*—Kinzer, Plyer, Dorn, McEachran & Jambor

[57] ABSTRACT

This is concerned with a fishtape reel which is in the nature of an inwardly opening circumferential housing with a closure for the inside which functions as a handle and also as a reeling and dereeling unit and, at the same time, closes the inner periphery of the reel or housing.

16 Claims, 2 Drawing Sheets

FISHTAPE REEL AND HANDLE

SUMMARY OF THE INVENTION

This invention is concerned with a fishtape reel and is more specifically in the nature of a housing of a circumferential nature to enclose and hold a fishtape and also a second housing or handle inside of the first which is slidably or rotatably mounted therein and is constructed and arranged to function as a reeling or dereeling unit for the fishtape.

A primary object of the invention is a fishtape reel or housing which winds and unwinds the fishtape from the inside of the coil of the fishtape rather than from the outside.

Another object is a unit of the above type which has a reduced tendency to tangle the fishtape.

Another object is a fishtape case which feeds on the inside.

Another object is a fishtape reel or case which has two outer identical parts.

Another object is a fishtape housing of the above type which has two identical inner housing parts.

Another object is a unit of the above type which has a socket in the side wall for anchoring the free end of the fishtape to prevent it from dereeling.

Another object is a fishtape case of the above type which may be viewed as not having a handle.

Another object is a fishtape case of the above type in which the fishtape would exit and enter the case from an opening located on an inner ring and out of the side of the case.

Other objects will appear from time to time in the ensuing specification and drawings.

BRIEF DESCRIPTION OF THE PREFERRED EMBODIMENT

Figure 3:
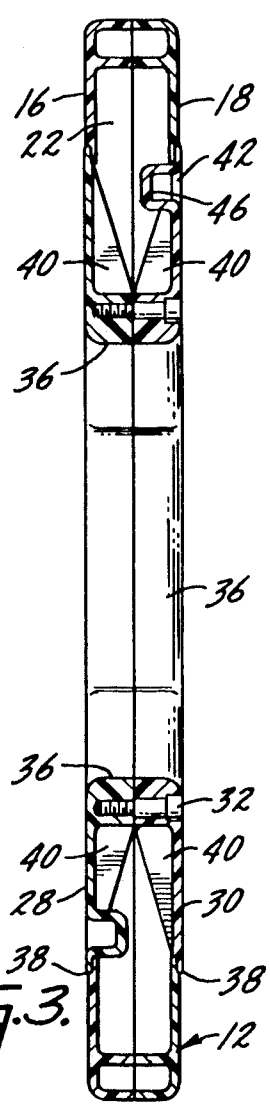
FIG. 3 is a section along line 3—3 of FIG. 2 but showing a full housing.
Figure 2:
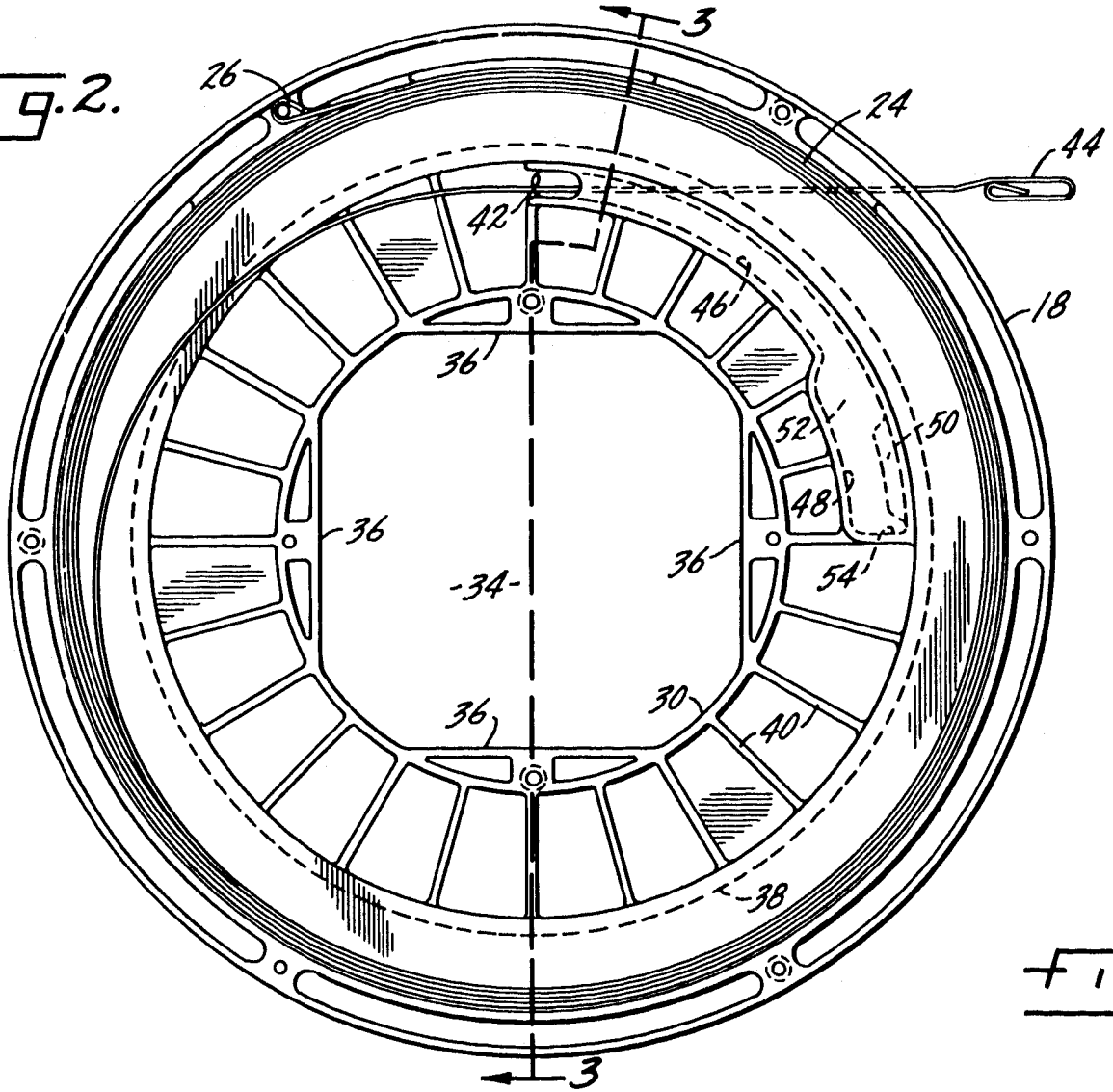
FIG. 2 is an inside view of the top housing half of FIG. 1.
Figure 1:
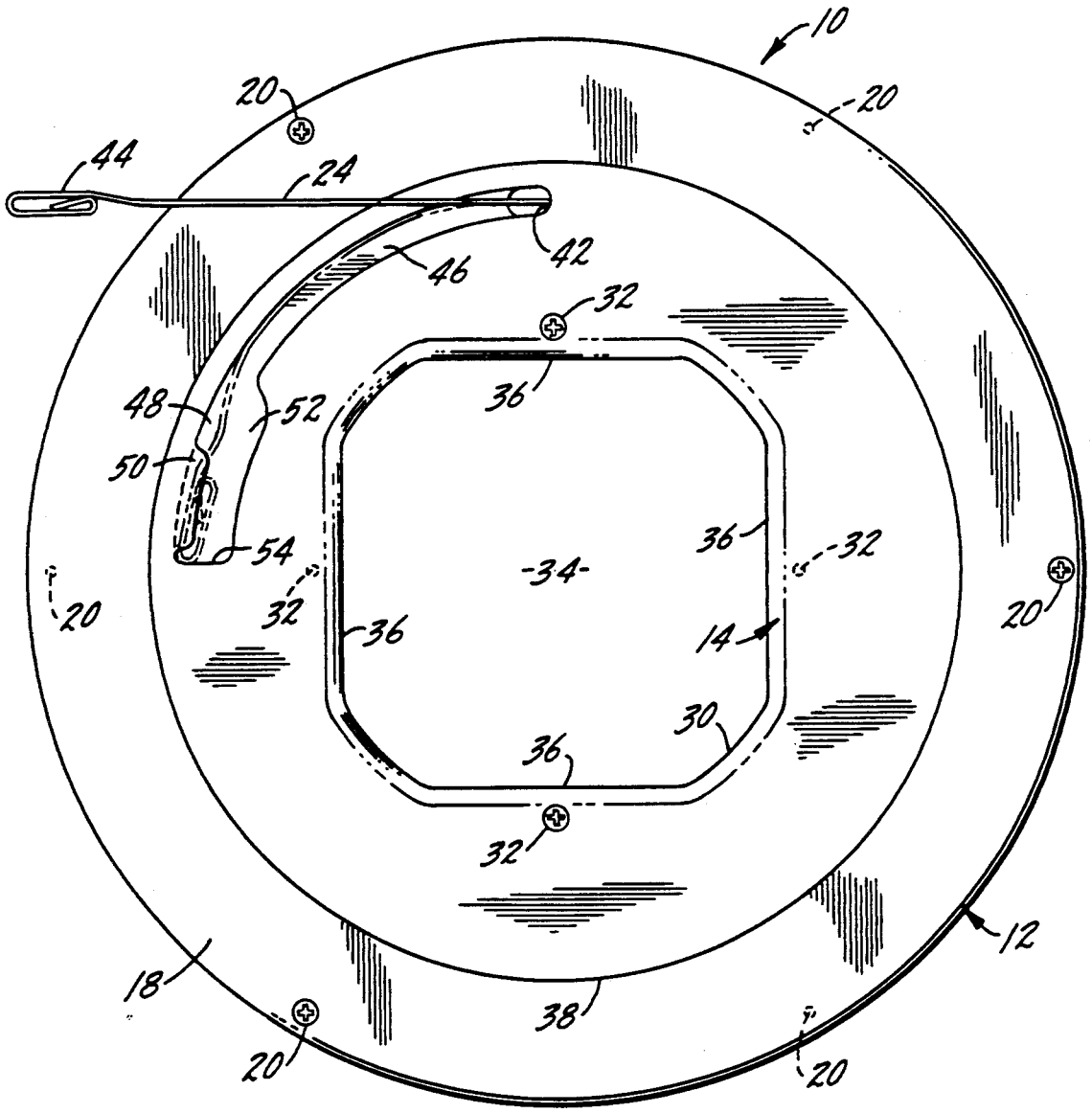
FIG. 1 is a side view of the unit.

In FIG. 1 a fishtape reel or housing is indicated generally at 10 and is made up more or less of two basic parts, an outer housing 12 and an inner housing 14. As shown in FIG. 3, the outer housing 12 is made up of two halves, 16 and 18, which are clamped or held together with a suitable number of screws 20 or the like which are spaced around the outer periphery so that the two housing halves provide a circumferential chamber 22 for reception and enclosure of a fishtape, indicated generally at 24 in FIG. 2. The inner end of the fishtape, as at 26, may be anchored on one of the screws 20 or it may have a separate anchoring if desired. It will be noted that the fishtape 24 is wound inside of the cavity or chamber 22 from the inside so that the natural resiliency of the tape causes it to coil outwardly as it is wound therein.

The inner housing 14 is in the nature of a handle or enclosure and also may have two housing halves 28 and 30 which are held together by a suitable number of screws or bolts 32 at appropriate intervals around the inner periphery or opening 34 through the center. It will be noted in FIGS. 1 and 2 that the inner opening 34 has a sort of polygonal shape with a series of straight sides 36 so that the user can insert his hand into the center and have leverage against a flat surface. It will also be noticed in FIG. 3 that the inner and outer housing halves have overlapping flanges 38 which will slide or rotate relative to each other so that the inner housing may be rotated relative to the outer housing or vice versa. In certain designs it may be desirable to have a lubricant channel between the two flanges to insure ease of relative rotation. The two inner housing halves 28 and 30 have generally radially disposed webs 40 for strength and rigidity.

The side wall of each of the inner housing halves 28 and 30 has an opening 42 at a suitable location through which the outer end 44 of the fishtape may project. The structure and contouring is such that the fishtape will be biased sideways or somewhat axially so that it will exit the case or housing.

As shown in FIG. 1, the side wall of each of the inner housing halves is provided with a channel 46 which merges into the opening 42 at one end. The channel is formed with a socket 48 at the other end which has an offset or riser 50 toward the closed end. The end of the fishtape may be positioned by flexing the end of the fishtape in the channel through an the enlargement 52 then allowing it to spring outwardly behind the riser 50 which will hold it in place. Since the uncoiling tendency of the tape will tend to cause the inner and outer housings 12 and 14 to rotate relative to each other, with the outer end 44 of the fishtape in the socket 52, behind the ledge 50, and against the end wall 54, the fishtape on its own will be prevented from rotating the inner and outer housings relative to each other.

The use, operation and function of the invention are as follows.

The fishtape case shown and described here is in the nature of a two piece unit, an inner housing and an outer housing, which rotate relative to each other. Each housing half, be it the outside or the inside, is made of two halves which are identical. Thus, only two sets of molds are necessary, one to make the two housing halves of the outer housing and the other to make the two halves of the inner housing. In the case of the inner housing, both halves will have an opening such as at 42 in FIG. 3, but only one of them will be used. Both will also have the socket arrangement 46–54 for the outer end of the fishtape but, again, only one will be used. The two halves are brought together at their abutting edges, the exterior peripheral edges of the inner housing and the interior peripheral edges of the outer housing with overlapping sliding flanges which completes an enclosed case or container for the fishtape.

The unit has the advantage that the fishtape is wound from the inside so that its natural flexibility will keep it coiled smoothly in the outer part of the case and will avoid tangling which is common in prior fishtape cases.

The center opening through the inner housing has polygonal sides or surfaces so that these may be grasped in the nature of handles when the two housings are being rotated relative to each other. The socketing arrangement for the outer end of the fishtape as shown in FIG. 1 has the advantage that the tape ca be locked in place and the housings will not tend to rotate paying out the tape on its own.

While the preferred form and several variations have been shown and suggested, it should be understood that suitable additional modifications, changes, substitutions and alterations may be made without departing from the invention's fundamental theme.

The embodiments of the invention in which an exclusive property or privilege is claimed are defined as follows:

1. In an electrician's fishtape reel, a pair of complementary, generally annular, side by side halves fitted together that form a generally enclosed annular case for a fishtape, each half being formed of slidingly interfitting inner and outer generally annular portion which define paired inner and outer halves that rotate relative to each other, and means joining the paired inner and outer halves so that they rotate as a unit relative to each other, one inside the other, and further characterized by and including a tangential outlet opening in the side of at least one of the inner halves so that a fishtape may be wound within itself in the outer half and withdrawn through the opening.

2. The structure of claim 1 further characterized by and including a peripheral socket in the side wall of the inner half arranged relative to the outlet so that the outer end of the fishtape may be stored when the tape is substantially fully wound in the reel.

3. The structure of claim 2 further characterized in that the inner halves are identical and the outer halves are identical.

4. The structure of claim 2 in which the inner halves are connected to each other by screws as are the outer halves.

5. The structure of claim 2 further characterized by and including overlapping sliding flanges between the inner and outer halves.

6. The structure of claim 5 further characterized in that the flanges on the outer half are on the inside and the flanges on the inner half are on the outside.

7. In an electrician's fishtape reel, a generally annular case closed peripherally on the outside and open peripherally on the inside, a handle slidably mounted on and otherwise closing the inside of the case with a side opening therein, and a fishtape wound in the case exiting through the side opening of the handle so that when the case and handle are rotated relative to each other the fishtape will be reeled in or out of the angular case.

8. The structure of claim 7 further characterized in that the handle is circumferentially continuous inside of the annular case.

9. The structure of claim 8 further characterized by and including a socket in the side of the handle for accepting and holding the outer end of the fishtape when the fishtape has been reeled in.

10. A method of handling, extending and storing a somewhat rigid but to a substantial degree flexible fishtape in a coil, including the steps of providing a generally annular housing of an outer diameter opening inwardly such that the tape may be coiled therein without taking a permanent set, closing the outer peripheral area of the housing so that the tape will be constrained from expanding when it is coiled therein, leaving the interior of the housing open radially inwardly so that the tape may otherwise be moved therethrough in a radial inward direction, anchoring the outer end of the tape in the outer portion of the housing's periphery, coiling the tape in the housing and allowing it to freely uncoil outwardly until it is otherwise constrained by the housing, providing a second annular housing which is smaller in diameter than the first housing and of an appropriate size so that it will fit inside of the first housing, allowing the second annular housing to be open outwardly, interfitting the housing so that the inner opening of the outer housing meshes with and is otherwise substantially closed by the outer open periphery of the second housing withdrawing the inner end of the tape from the inside of the coil through the inner opening of the housing at a defined tangential point, rotating the housing about the defined tangential point in the direction that tends to cause the inner end of the tape to move outwardly of the case at the defined tangential point, deflecting the tape axially somewhat relative to the housing at the defined tangential point so that the tape will clear the housing as it is withdrawn, and defining the tangential point by providing an opening through the side wall of the second annular housing.

11. The method of claim 10 further characterized by recoiling the tape in the housing by moving the housing at the defined tangential point in the opposite direction.

12. The method of claim 11 further characterized by and including the step of allowing the tape to move freely through the defined tangential point while it is being either extended from the housing or withdrawn and recoiled in the housing.

13. The method of claim 12 further characterized by and including the step of anchoring the inner end of the tape in the side of the housing when the tape has been fully recoiled within the housing to prevent it from tending to uncoil and depart on its own.

14. The method of claim 10 further characterized by and including the step of closing the second housing peripherally inwardly.

15. A method of handling, extending and storing a somewhat rigid but to a substantially degree flexible fish tape in a coil, including the steps of providing a generally annular housing of an outer diameter such that the tape may be coiled therein without taking a permanent set, closing the outer peripheral area of the housing so that the tape will be constrained from expanding when it is coiled therein, leaving the interior of the housing opening radially inwardly so that the tape may be moved there through in a radial inward direction, anchoring the outer end of the tape in the outer portion of the housing's periphery, coiling the tape in the housing and allowing it to freely uncoil outwardly until it is otherwise constrained by the housing, providing a second annular housing which is smaller in diameter than the first housing and of an appropriate size so that it will fit inside of the first housing, allowing the second annular housing to be open outwardly, interfitting the housings so that the inner opening of the outer housing meshes with and is otherwise substantially closed by the outer open periphery of the second housing, withdrawing the inner end of the tape from the inside of the coil through an opening in the side wall of the inner housing, rotating the outer housing about the inner housing in the direction that tend to cause the inner end of the tape to move outwardly of the case through the opening in the side wall of the inner housing, and deflecting the tape axially somewhat relative to the inner housing at the opening so that the tape will clear the inner housing as it is withdrawn.

16. The method of claim 15 further characterized by and including the step of closing the second housing peripherally inwardly.

* * * * *